US008564586B2

(12) United States Patent
Chiou

(10) Patent No.: US 8,564,586 B2
(45) Date of Patent: Oct. 22, 2013

(54) DISPLAY DRIVING CIRCUIT AND METHOD THEREOF

(75) Inventor: Yu-Wen Chiou, Tainan County (TW)

(73) Assignee: Himax Technologies Limited, Tainan (TW)

( * ) Notice: Subject to any disclaimer, the term of this patent is extended or adjusted under 35 U.S.C. 154(b) by 126 days.

(21) Appl. No.: 13/032,715

(22) Filed: Feb. 23, 2011

(65) Prior Publication Data

US 2011/0175896 A1 Jul. 21, 2011

Related U.S. Application Data

(62) Division of application No. 11/621,155, filed on Jan. 9, 2007, now abandoned.

(51) Int. Cl.
*G09G 5/00* (2006.01)

(52) U.S. Cl.
USPC ..... 345/212; 345/211; 345/30; 345/76

(58) Field of Classification Search
USPC ..... 345/76–81, 30, 211–214
See application file for complete search history.

(56) References Cited

U.S. PATENT DOCUMENTS

| | | | | |
|---|---|---|---|---|
| 7,928,932 | B2 * | 4/2011 | Yamaguchi et al. | 345/76 |
| 2005/0073493 | A1 | 4/2005 | Chen et al. | |
| 2005/0104875 | A1 | 5/2005 | Kwak et al. | |
| 2005/0140600 | A1 | 6/2005 | Kim et al. | |
| 2007/0126663 | A1 * | 6/2007 | Kim et al. | 345/76 |
| 2007/0152924 | A1 * | 7/2007 | Chiou | 345/76 |
| 2011/0210990 | A1 | 9/2011 | Kim et al. | |

FOREIGN PATENT DOCUMENTS

| | | | |
|---|---|---|---|
| CN | 1617206 | A | 5/2005 |
| CN | 1622168 | A | 6/2005 |
| CN | 1622186 | A | 6/2005 |
| JP | 2004029752 | A | 1/2004 |
| TW | I228922 | A | 3/2005 |

* cited by examiner

*Primary Examiner* — Christopher E Leiby
(74) *Attorney, Agent, or Firm* — Lowe Hauptman & Ham, LLP

(57) ABSTRACT

A display driving circuit has a scan switch, an assistant unit, several storage switches, and several storage units. The scan switch couples to a data line. The assistant unit couples to the scan switch. The storage switches couple to the assistant unit. Each storage unit couples to the assistant unit by one of the storage switches. The assistant unit is shared by the storage units to compensate for several driving voltages or several driving currents of the storage units.

13 Claims, 9 Drawing Sheets

DISPLAY DRIVING CIRCUIT AND METHOD THEREOF

RELATED APPLICATIONS

The present application is a divisional of U.S. application Ser. No. 11/621,155, filed on Jan. 9, 2007, which is herein incorporated by reference.

BACKGROUND

1. Field of Invention

The present invention relates to a flat panel display driving circuit, and more particularly relates to a display driving circuit with compensation of the driving voltages and the driving currents.

2. Description of Related Art

FIG. 1 is a display driving circuit of the prior art. In the ordinary FPD, the display driving circuit uses one assistant unit for each storage unit. Take the display driving circuit of FIG. 1 for example. The display driving circuit has several can switches (110 and 160), several assistant units (130 and 180), and several storage units (140 and 190). The scan switches (110 and 160) couple to the data lines (120 and 170) respectively. The assistant units (130 and 180) couple to the scan switches (110 and 160) respectively. The storage units (140 and 190) couple to the assistant units (130 and 180) respectively. Thus, each storage unit needs an assistant unit to compensate the driving voltages or currents thereof.

Since the assistant unit of the display driving circuit is configured by transistors or capacitors, the more the assistant units, the less the aperture ratio of the FPD. Therefore, a display driving circuit with fewer assistant units is needed.

SUMMARY

It is therefore an aspect of the present invention to provide a flat panel display driving circuit.

It is therefore another aspect of the present invention to provide a flat panel display driving circuit with compensation of the driving voltages and the driving voltages.

According to one embodiment of the present invention, the display driving circuit has a scan switch, an assistant unit, several storage switches, and several storage units. The scan switch couples to a data line. The assistant unit couples to the scan switch. The storage switches couples to the assistant unit. Each storage unit couples to the assistant unit via one of the storage switches. The storage units to compensate for several driving voltages or several driving currents of the storage units share the assistant unit.

According to another embodiment of the present invention, the display driving circuit transmits data signals through a data line to several storage units, wherein the data signals include driving voltages or currents in the storage units. The circuit has a scan switch, several storage switches, and an assistant unit. The scan switch has a first end coupled to the data line. Each storage switch has a first end coupled to one of the storage units. The assistant unit couples between a second end of the scan switch and the second ends of the storage switches, compensates offsets of the driving voltages or currents in the storage units. The scan switch is turned on during a scan period and the storage switches are sequentially turned on during the scan period.

According to another embodiment of the present invention, the display driving circuit has several storage units, an assistant unit, several storage switches, and a scan switch. Each storage unit has at least one storage capacitor storing a data signal, at least one driving transistor controlled by the data signal, and at least one organic light emitting diode driven by the driving transistor. The assistant unit is shared by the storage units to compensate for several driving voltages or several driving currents of the storage units. The storage switches are respectively coupled each storage unit to the assistant unit. The scan switch couples the assistant unit to a data line.

According to another embodiment of the present invention, the display driving method includes transmitting a data signal to an assistant unit that is coupled to several storage units through several storage switches, and switching to transmit the data signal from the assistant unit to one of the storage units via the storage switches. The assistant unit is shared by the storage units to compensate for several driving voltages or several driving currents of the storage units.

According to another embodiment of the present invention, the display driving circuit transmitting data signals through a data line, wherein the data signals include driving voltages or currents. The circuit has several storage switches and several storage units. The storage switches are respectively coupled to the data line. Each storage unit is coupled to the data line by one of the storage switches, wherein the storage units are arranged to store the driving voltages or currents of the data signals.

It is to be understood that both the foregoing general description and the following detailed description are by examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1:
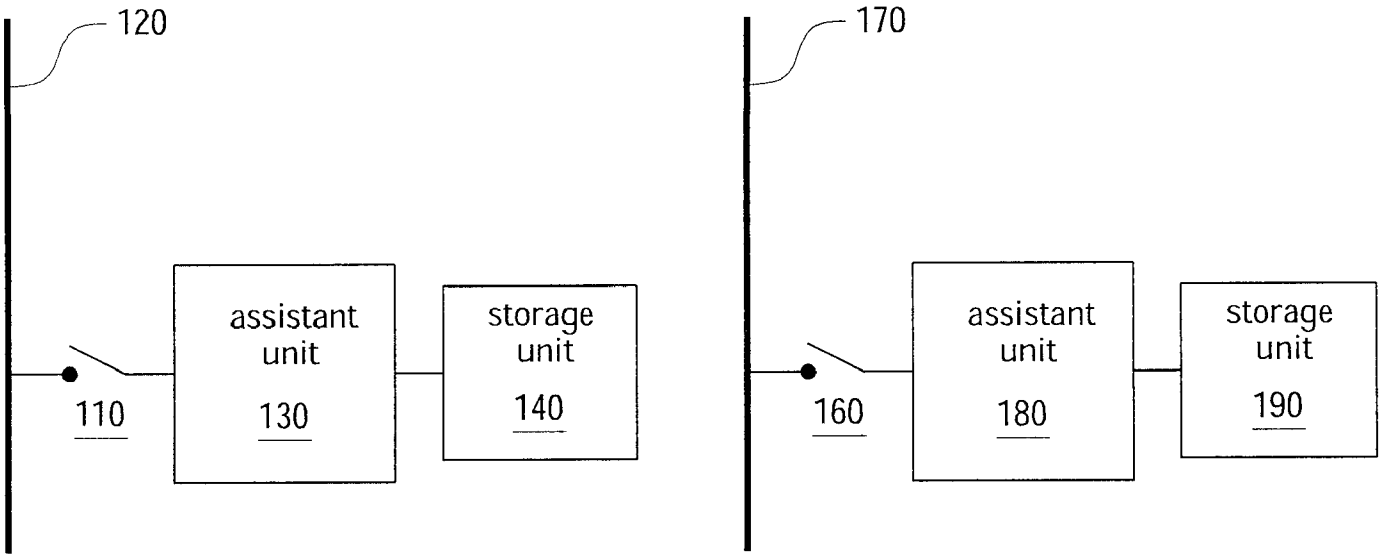
Fig. 1 (prior art)
FIG. 1 is a display driving circuit of the prior art.

Reference will now be made in detail to the present preferred embodiments of the invention, examples of which are illustrated in the accompanying drawings. Wherever possible, the same reference numbers are used in the drawings and the description to refer to the same or like parts.

The invention present here uses one assistant unit cooperating with several switches to compensate for the driving voltages or the driving currents of several storage units. This design increases the aperture ratio of the FPD.

Figure 2:
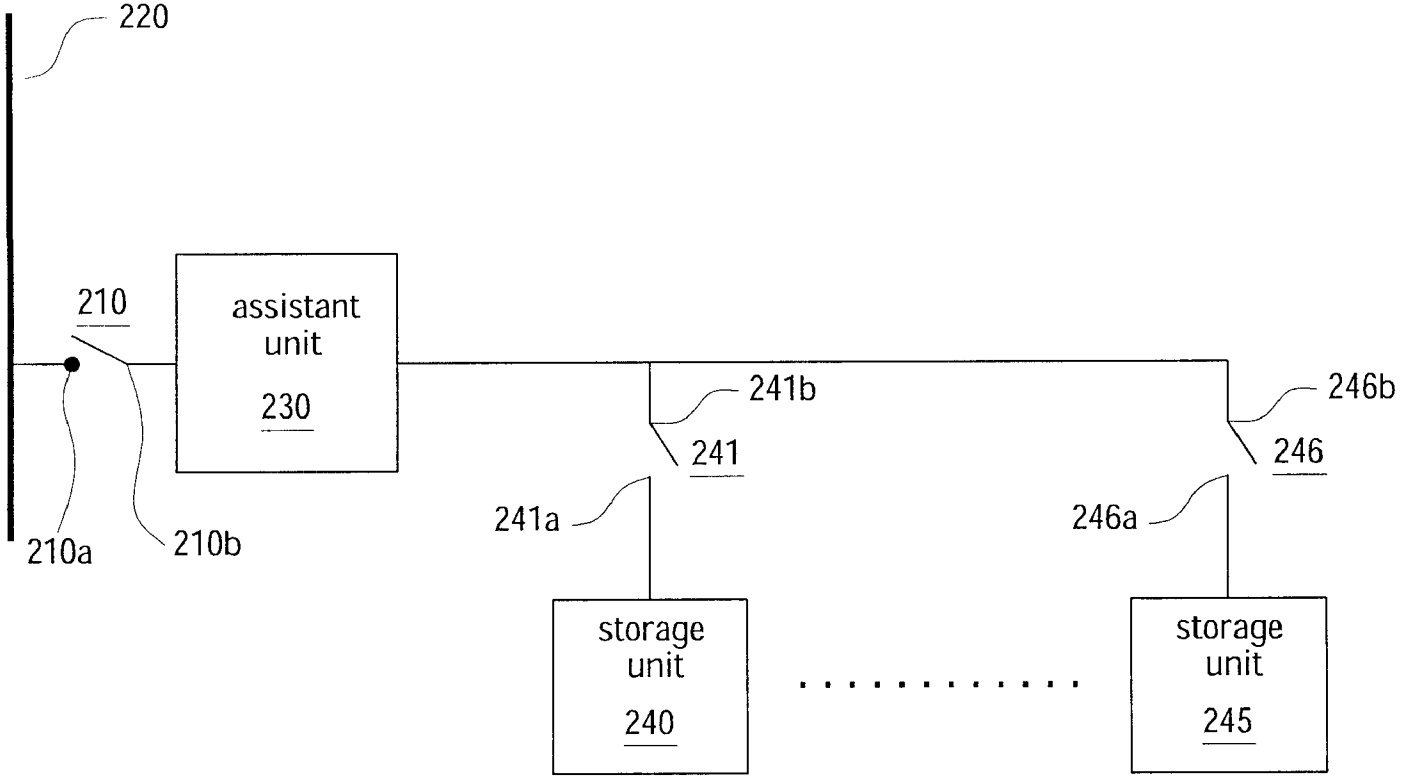
FIG. 2 is a block diagram according to one embodiment of the present invention.

FIG. 2 is a block diagram according to one embodiment of the present invention. The display driving circuit has a scan switch 210, an assistant unit 230, several storage switches 241 and 246, and several storage units 240 and 245. The scan switch 210 couples to a data line 220. The assistant unit 230 couples to the scan switch 210. The storage switches 241 and 246 couples to the assistant unit 230. Each storage unit couples to the assistant unit 230 by one of the storage switches. The assistant unit 230 is shared by the storage units 240 and 245 to compensate for several driving voltages or several driving currents of the storage units 240 and 245.

Moreover, the display driving circuit transmits the data signals through the data line 220 to the storage units 240 and 245, wherein the data signals include driving voltages or currents in the storage units 240 and 245. The circuit has the scan switch 210, several storage switches 241 and 246, and the assistant unit 230. The scan switch 210 has a first end 210*a* coupled to the data line 220. The storage switches (such as 241 and 246) each have a first end (such as 241*a* and 246*a*) coupled to one of the storage units (such as 240 and 245). The assistant unit 230 couples between a second end 210*b* of the scan switch 210 and second ends (241*b* and 246*b*) of the storage switches 241 and 246. The assistant unit 230 compensates offsets of the driving voltages or currents in the storage units (such as 240 and 245). The scan switch 210 is turned on during a scan period and the storage switches 241 and 246 are sequentially turned on during the scan period.

Figure 3:
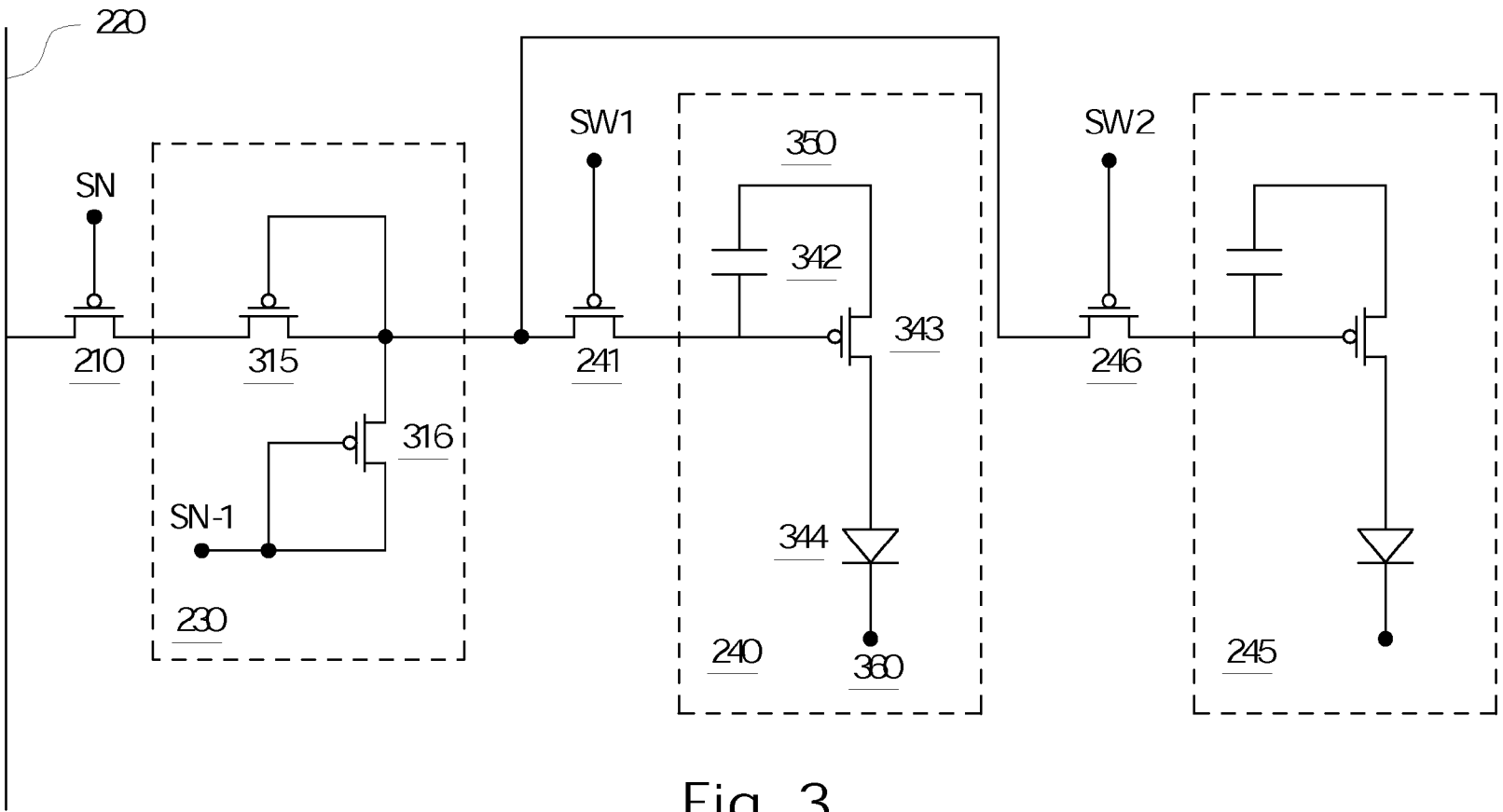
FIG. 3 is a display driving circuit according to one embodiment of the present invention.

FIG. 3 is a display driving circuit according to one embodiment of the present invention. FIG. 3 takes two storage units for example to show the storage units more clearly to explain how the display driving circuit operates. The display driving circuit has two storage units 240 and 245, an assistant unit 230, two storage switches 241 and 246, and a scan switch 210. Each of the storage units 240 and 245 has a storage capacitor 342, a driving transistor 343, and an organic light emitting diode 344. The storage capacitor 342 is arranged to store a data signal. The driving transistor 343 is controlled by the data signal to drive the light emitting diode 344. The assistant unit 230 is shared by the storage units 240 and 245 to compensate for the driving voltages or the driving currents of the storage units 240 and 245. The storage switches 241 and 246 respectively couple each storage unit 240 and 245 to the assistant unit 230 and are controlled by the signals SW1 and SW2. The scan switch 210 couples the assistant unit 230 to a data line 220.

The storage unit has many kinds of designs. The storage units 240 and 245 are similar, take the storage unit 240 for example; the source of the driving transistor 343 and one end of the storage capacitor 342 couple to a power end 350. The gate of the driving transistor 343 couples to another end of the storage capacitor 342. The drain of the driving transistor 343 couples to a positive pole of the organic light emitting diode 344. The negative pole of the organic light emitting diode 344 couples to a ground end 360.

The scan switch 210 is arranged to transmit the data signals from the data line 220 to the assistant unit 230. The data signals are transmitted to the assistant unit 230 during the period that the scan switch 210 is turned on. The scan switch 210 is controlled by the signal SN generated by the data driver to transmit the data signals to the corresponding assistant unit and storage units.

The assistant unit 230 has at least one transistor (such as transistor 315 or 316) or at least one capacitor (not shown). The transistor or capacitor of the assistant unit 230 stabilizes the driving voltages or driving currents of the storage units 240 and 245. Thus, the driving voltages or driving currents of the storage units 240 and 245 are compensated thereby. Besides, according to the amount or types of the storage units coupled to the assistant units, the designer can design the assistant unit with different combinations of transistors, capacitors, or both.

Moreover, the assistant unit 230 further provides a low voltage for the storage capacitor 342. When the signal SN−1 is low, the transistor 361 is turned on to transmit the low voltage of the signal SN−1. Then, the low voltage is transmitted to the storage capacitor 342 through the storage switch 241. The low voltage can help the data signals write into the storage capacitor 342 more efficiently, and thereby the organic light emitting diode 344 operates more efficiently, too.

By the control of these two storage switches 241 and 246, the data signals are sequentially transmitted to the storage units 240 and 245. Therefore, when the scan switch 210 is turned on, the storage switches 240 and 245 are arranged to respectively transmit the data signals from the assistant unit 230 to the corresponding storage units 240 and 245.

Therefore, by the description above, the present invention also provides a display driving method. The method includes transmitting a data signal to the assistant unit 230 that is coupled to several storage units 240 and 245 through several storage switches 241 and 246 respectively, and switching to transmit the data signal from the assistant unit 230 to one of the storage units 240 and 245 by the storage switches 241 and 246 respectively. The assistant unit 230 is shared by the storage units 240 and 245 to compensate for several driving voltages or several driving currents of the storage units 240 and 245.

Figure 4:
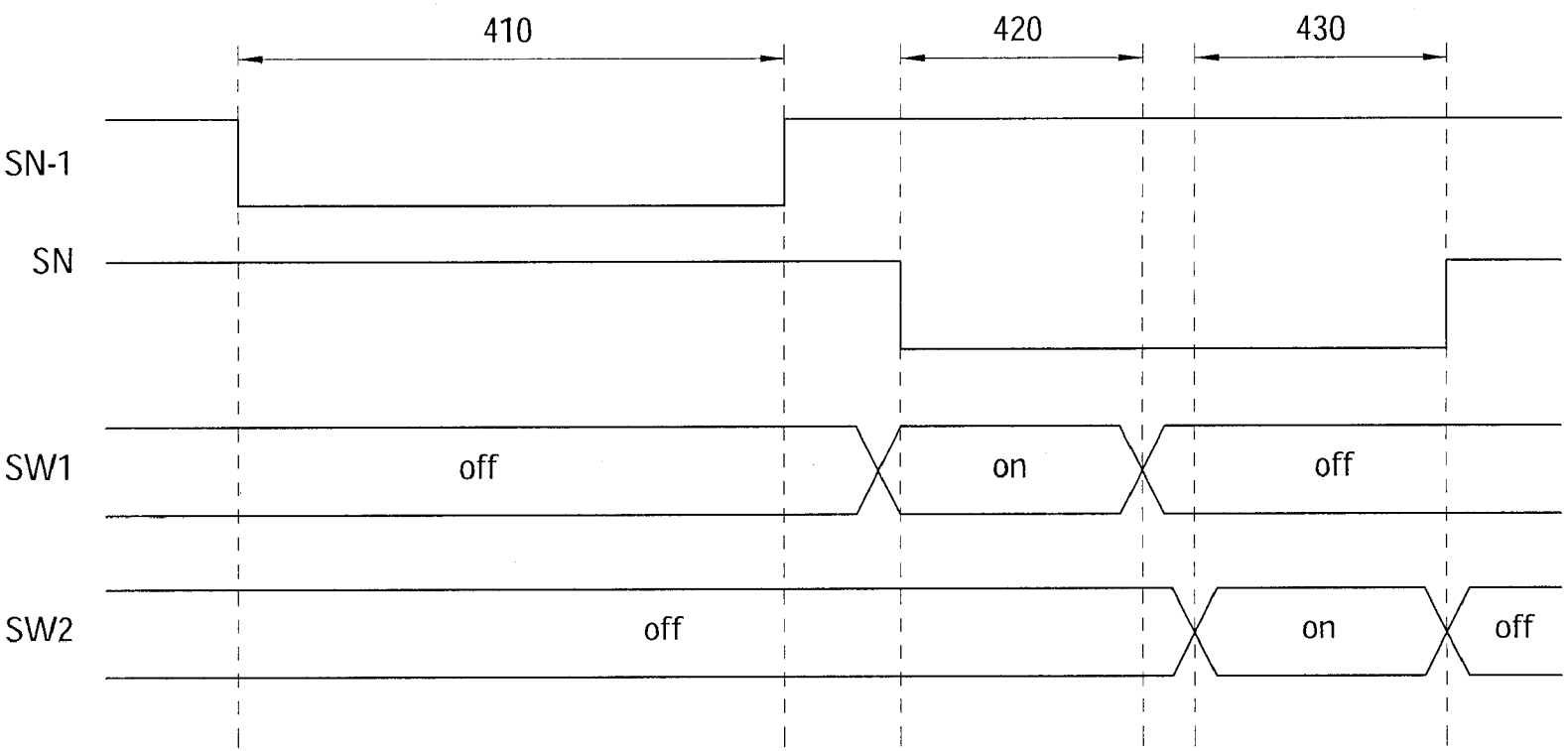
FIG. 4 is a driving waveform of the display driving circuit according to one embodiment of the present invention.

FIG. 4 is a driving waveform of the display driving circuit according to one embodiment of the present invention. Refer to FIG. 3 at the same time; before the scan switch 210 is turned on by the signal SN of a low voltage, the signal SN−1 is low to provide a low voltage for the storage capacitor 342 in period 410 as described above. Then, the signal SN is low to turn on the scan switch 210 to transmit the data signals to the assistant unit 230. Meanwhile, the storage switches 241 and 246 are turned on by the signals SW1 and SW2 in the periods 420 and 430 sequentially to transmit the data signals to the storage units 240 and 245 respectively. Thus, from this waveform, the invention is operated by one assistant unit shared by several storage units to compensate for the driving voltages or the driving currents of the storage units.

Figure 5:
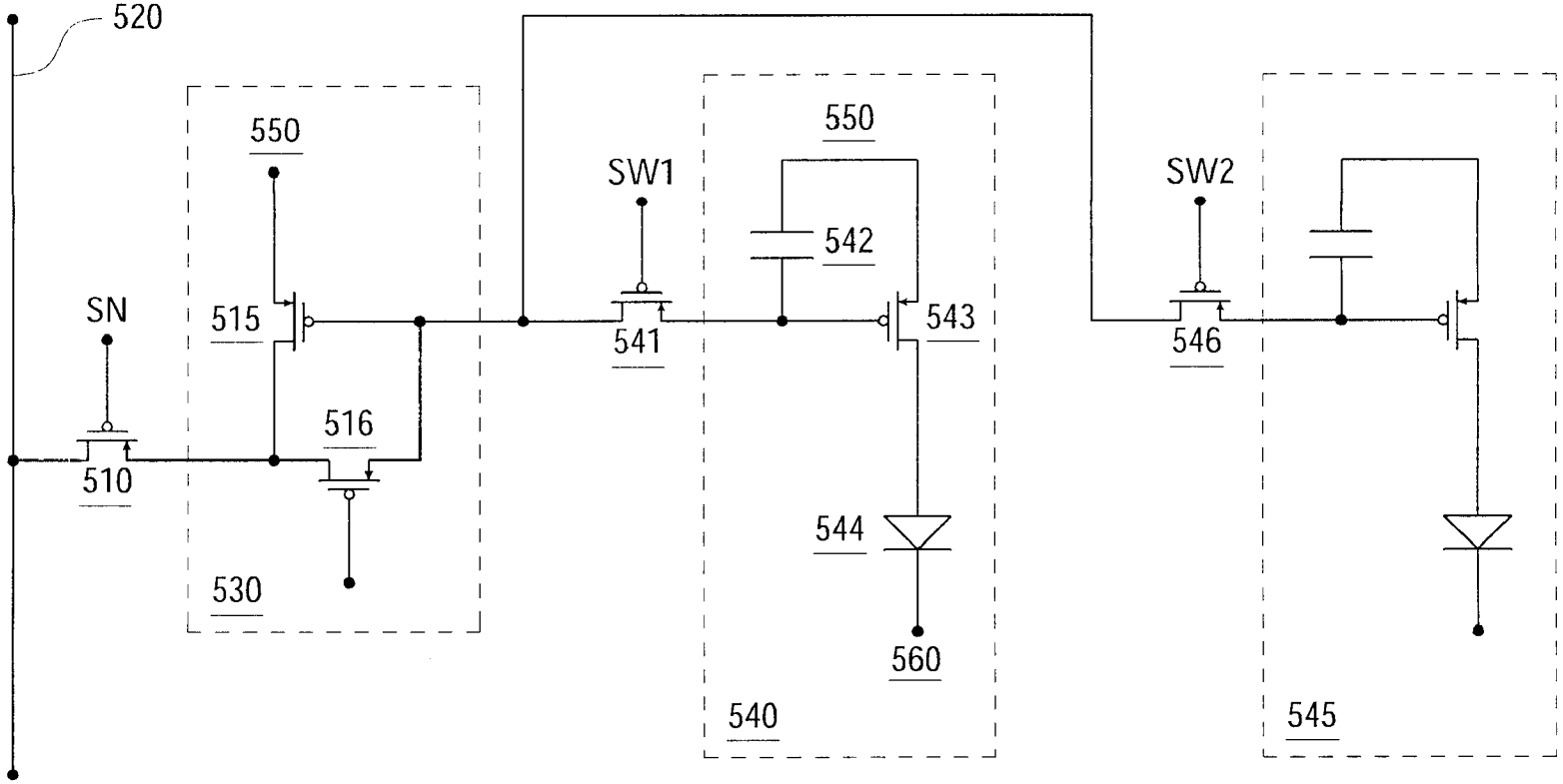
FIG. 5 is a display driving circuit according to another embodiment of the present invention.

FIG. 5 is a display driving circuit according to another embodiment of the present invention. FIG. 5 takes two storage units for example to show the storage units of current type pixels. The display driving circuit has two storage units 540 and 545, an assistant unit 530, two storage switches 541 and 546, and a scan switch 510. Each of the storage units 240 and 245 has a storage capacitor 542, a driving transistor 543, and an organic light emitting diode 544. The storage capacitor 542 is arranged to store a data signal. The driving transistor 543 is controlled by the data signal to drive the light emitting diode 544. The assistant unit 530 is shared by the storage units 540 and 545 to compensate for the driving currents of the storage units 540 and 545. The storage switches 541 and 546 respectively couple each storage unit 540 and 545 to the assistant unit 530 and are controlled by the signals SW1 and SW2. The scan switch 510 couples the assistant unit 530 to a data line 520.

The storage units 540 and 545 are similar, take the storage unit 540 for example; the source of the driving transistor 543 and one end of the storage capacitor 542 couple to a power end 550. The gate of the driving transistor 543 couples to another end of the storage capacitor 542. The drain of the driving transistor 543 couples to a positive pole of the organic light emitting diode 544. The negative pole of the organic light emitting diode 544 couples to a ground end 560. Moreover, the assistant unit 530 has transistors 515 and 516, wherein the transistors 515 couples to the power end 550.

Figure 6:
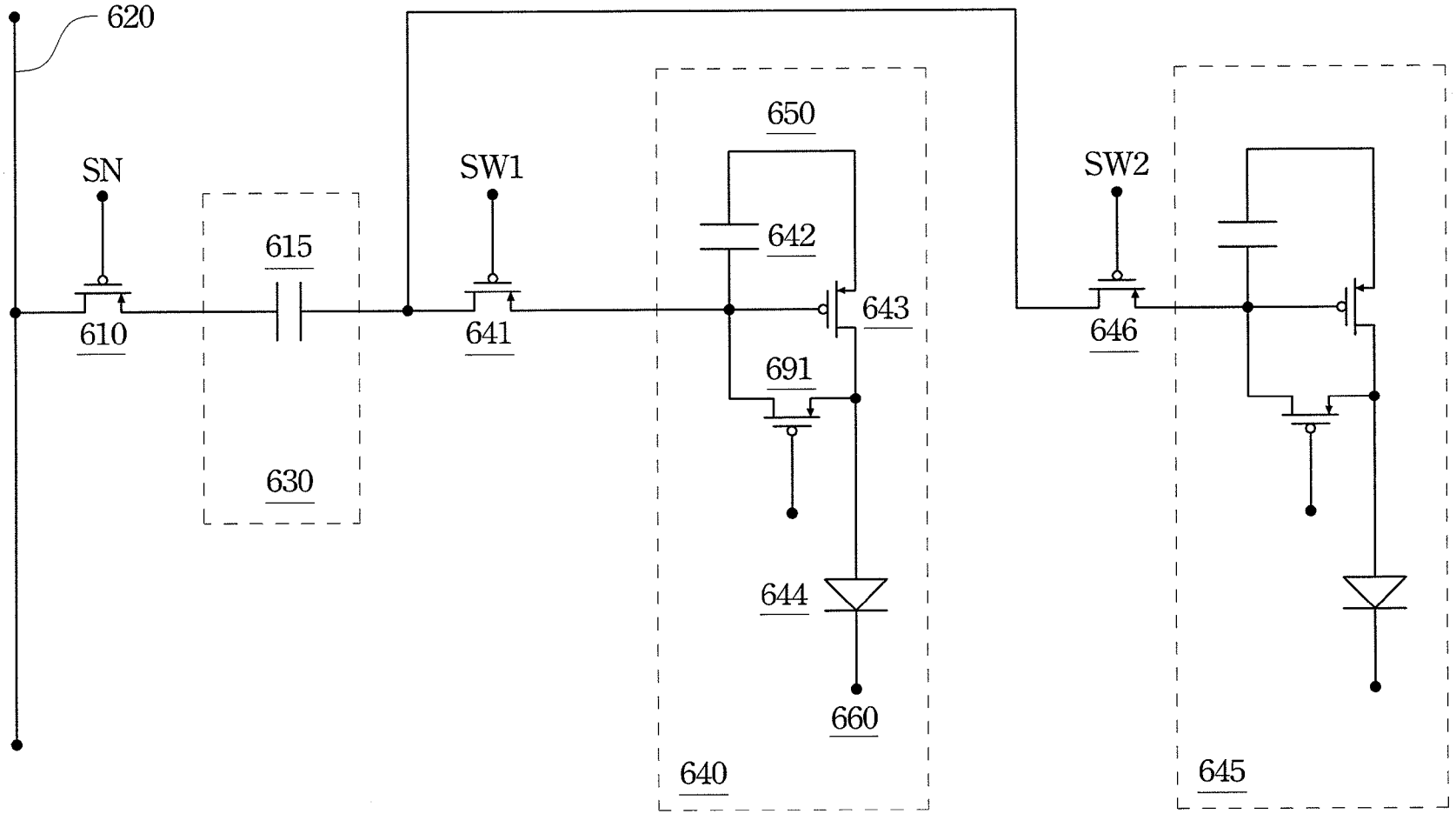
FIG. 6 is a display driving circuit according to another embodiment of the present invention.

FIG. 6 is a display driving circuit according to another embodiment of the present invention. FIG. 6 takes two storage units for example to show the storage units of voltage type pixels. The display driving circuit has two storage units 640 and 645, an assistant unit 630, two storage switches 641 and 646, and a scan switch 610. Each of the storage units 640 and 645 has a storage capacitor 642, a driving transistor 643, and an organic light emitting diode 644. The storage capacitor 642 is arranged to store a data signal. The driving transistor 643 is controlled by the data signal to drive the light emitting diode 644. The assistant unit 630 is shared by the storage units 640 and 645 to compensate for the driving voltages of the storage units 640 and 645. The storage switches 641 and 646 respectively couple each storage unit 640 and 645 to the assistant unit 630 and are controlled by the signals SW1 and SW2. The scan switch 610 couples the assistant unit 630 to a data line 620.

The storage units 640 and 645 are similar, take the storage unit 640 for example; the source of the driving transistor 643 and one end of the storage capacitor 642 couple to a power end 650. The gate of the driving transistor 643 couples to another end of the storage capacitor 642. The drain of the driving transistor 643 couples to a positive pole of the organic light emitting diode 644. The negative pole of the organic light emitting diode 644 couples to a ground end 660. A transistor 691 couples between the gate and the drain of the driving transistor 643. Moreover, the assistant unit 630 has a capacitor 615.

Figure 7:
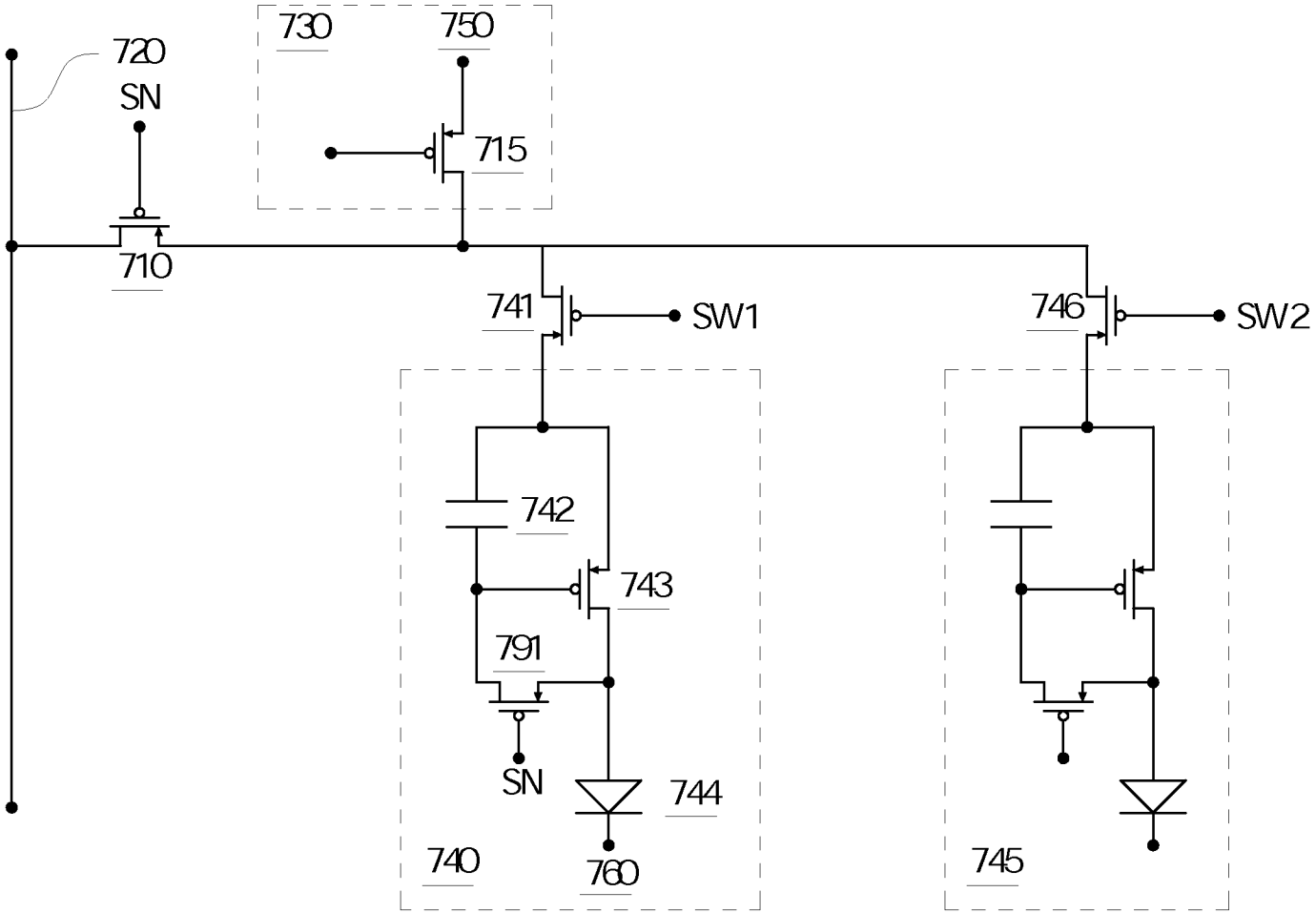
FIG. 7 is a display driving circuit according to another embodiment of the present invention.

FIG. 7 is a display driving circuit according to another embodiment of the present invention. FIG. 7 takes two storage units for example to show the storage units of current type pixels. The display driving circuit has two storage units 740 and 745, an assistant unit 730, two storage switches 741 and 746, and a scan switch 710. Each of the storage units 740 and 745 has a storage capacitor 742, a driving transistor 743, and an organic light emitting diode 744. The storage capacitor 742 is arranged to store a data signal. The driving transistor 743 is controlled by the data signal to drive the light emitting diode 744. The assistant unit 730 is shared by the storage units 740 and 745 to compensate for the driving current of the storage units 740 and 745. The storage switches 741 and 746 respectively couple each storage unit 740 and 745 to the assistant unit 730 and are controlled by the signals SW1 and SW2. The scan switch 710 couples the assistant unit 730 to a data line 720.

The storage units 740 and 745 are similar, take the storage unit 740 for example; the source of the driving transistor 743 and one end of the storage capacitor 742 couple to the storage switches 741. The gate of the driving transistor 743 couples to another end of the storage capacitor 742. The drain of the driving transistor 743 couples to a positive pole of the organic light emitting diode 744. The negative pole of the organic light emitting diode 744 couples to a ground end 760. A transistor 791 couples between the gate and the drain of the driving transistor 743. Moreover, the assistant unit 730 has a transistor 715 coupled between a power end 750 and the storage switches 741.

Figure 8:
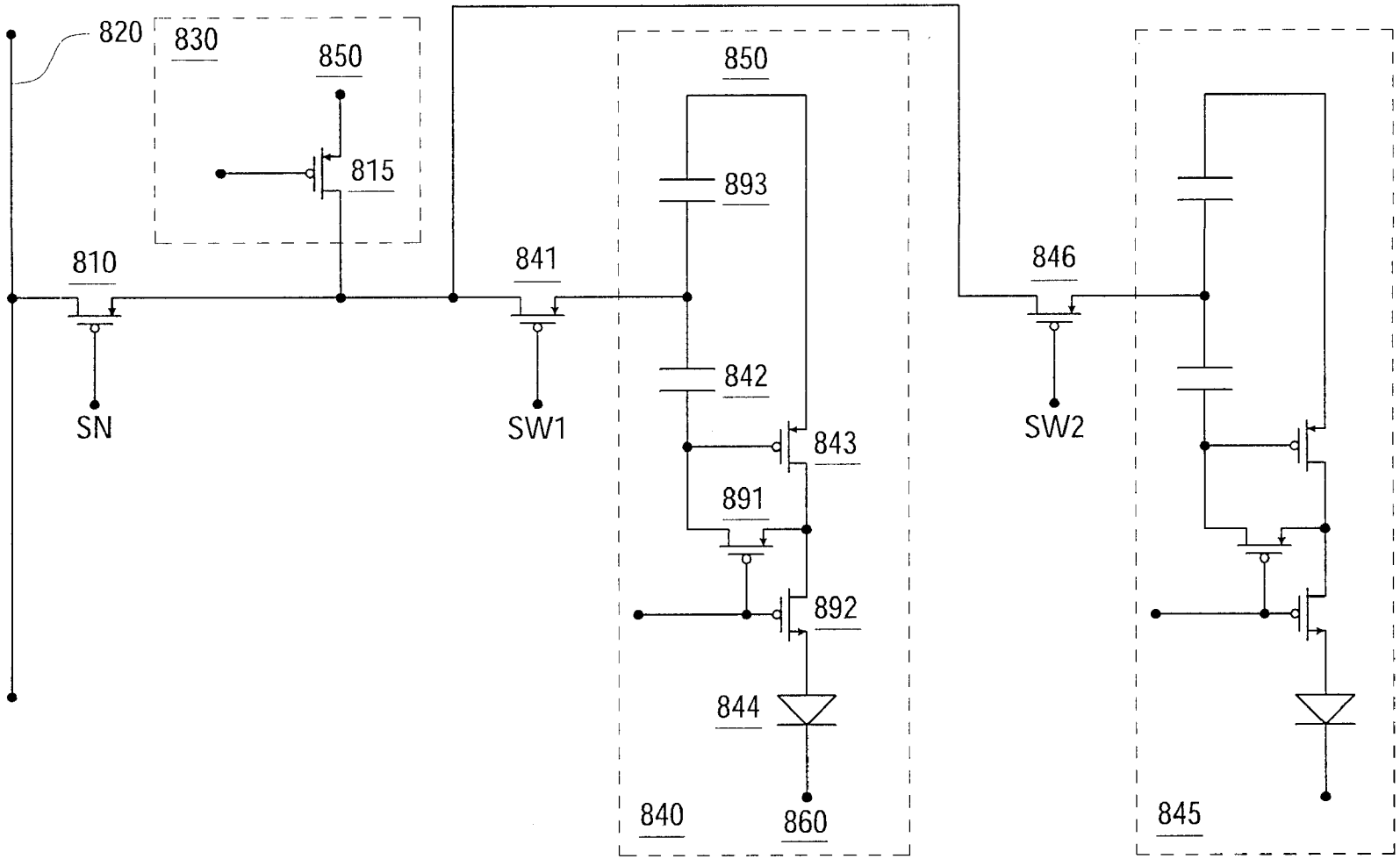
FIG. 8 is a display driving circuit according to another embodiment of the present invention.

FIG. 8 is a display driving circuit according to another embodiment of the present invention. FIG. 8 takes two storage units for example to show the storage units of voltage type pixels. The display driving circuit has two storage units 840 and 845, an assistant unit 830, two storage switches 841 and 846, and a scan switch 810. Each of the storage units 840 and 845 has a storage capacitor 842, a driving transistor 843, and an organic light emitting diode 844. The storage capacitor 842 is arranged to store a data signal. The driving transistor 843 is controlled by the data signal to drive the light emitting diode 844. The assistant unit 830 is shared by the storage units 840 and 845 to compensate for the driving voltage of the storage units 840 and 845. The storage switches 841 and 846 respectively couple each storage unit 840 and 845 to the assistant unit 830 and are controlled by the signals SW1 and SW2. The scan switch 810 couples the assistant unit 830 to a data line 820.

The storage units 840 and 845 are similar, take the storage unit 840 for example; the source of the driving transistor 843 and one end of the storage capacitor 842 couple to a power end 850. The gate of the driving transistor 843 couples to another end of the storage capacitor 842. The drain of the driving transistor 843 couples to a positive pole of the organic light emitting diode 844 by a transistor 892. The negative pole of the organic light emitting diode 844 couples to a ground end 860. A transistor 891 couples between the gate and the drain of the driving transistor 843, and a capacitor 893 couples between the power end 850 and the storage switch 841. Moreover, the assistant unit 830 has a transistor 815 coupled between the power end 850 and the storage switches 841.

Figure 9:
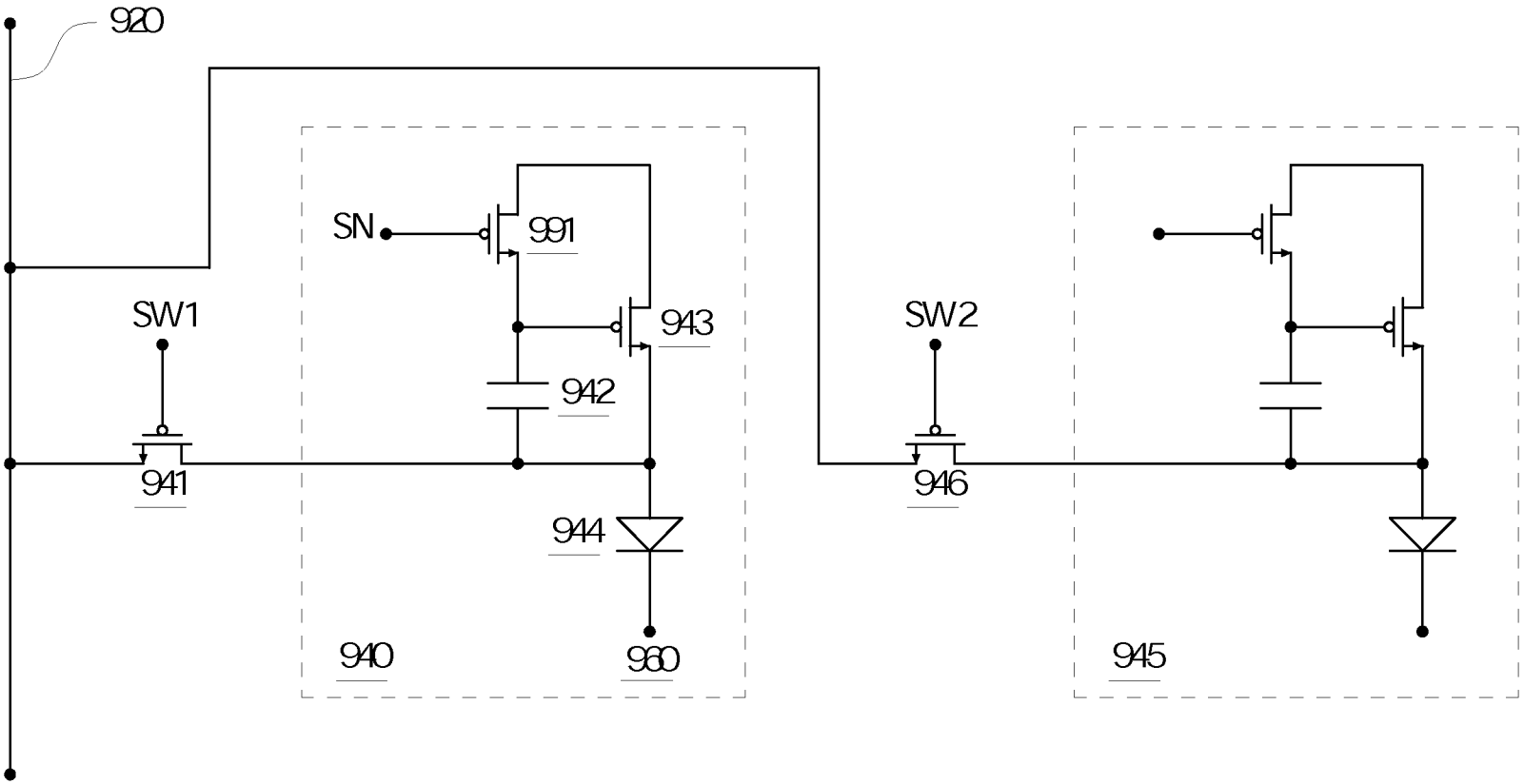
FIG. 9 is a display driving circuit according to another embodiment of the present invention.

FIG. 9 is a display driving circuit according to another embodiment of the present invention. FIG. 9 takes two storage units for example to show the storage units of current type pixels. The display driving circuit has two storage units 940 and 945, and two storage switches 941 and 946. Each of the storage units 940 and 945 has a storage capacitor 942, a driving transistor 943, and an organic light emitting diode 944. The storage capacitor 942 is arranged to store a data signal. The driving transistor 943 is controlled by the data signal to drive the light emitting diode 944. The storage switches 941 and 946 respectively couple each storage unit 940 and 945 to the data line 920 and are controlled by the signals SW1 and SW2.

The storage units 940 and 945 are similar, take the storage unit 940 for example; the drain of the driving transistor 943 and one end of the storage capacitor 942 couple to the storage switches 941. The gate of the driving transistor 943 couples to another end of the storage capacitor 942. The drain of the driving transistor 943 couples to a positive pole of the organic light emitting diode 944. The negative pole of the organic light emitting diode 944 couples to a ground end 960. A transistor 991 couples between the gate and the source of the driving transistor 943.

Therefore, if one assistant unit is shared by two storage units, one data line and one assistant unit are reduced. If one assistant unit is shared by three storage units, two data lines and two assistant units are reduced. Namely, if one assistant unit is shared by N storage units, (N−1) data lines and (N−1) assistant units are reduced. Thereby, the aperture ratio will be increased by the decrease of the amount of the assistant units.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display driving circuit, comprising:

a scan switch coupled to a data line;

an assistant unit directly coupled to the scan switch, wherein the assistant unit comprises only one capacitor;

a plurality of storage switches coupled to the scan switch through the one capacitor; and a plurality of storage units each coupled to the assistant unit by one of the storage switches, wherein one electrode of the one capacitor is directly coupled to the scan switch, and the other electrode of the one capacitor is directly coupled to the plurality of storage switches, and the assistant unit is shared by the storage units to compensate for a plurality of driving voltages or a plurality of driving currents of the storage units.

2. The display driving circuit as claimed in claim 1, wherein the scan switch is arranged to transmit a plurality of data signals from the data line to the assistant unit.

3. The display driving circuit as claimed in claim 1, wherein the assistant unit is arranged to provide a low voltage to the storage units.

4. The display driving circuit as claimed in claim 1, wherein when the scan switch is turned on, the storage switches are arranged to respectively transmit the data signals from the assistant unit to the corresponding storage units.

5. A display driving circuit for transmitting data signals through a data line to a plurality of storage units, wherein the data signals include driving voltages or currents in the storage units, the circuit comprising:

a scan switch having a first end coupled to the data line and a second end;

a plurality of storage switches each having a first end coupled to one of the storage units and a second end; and an assistant unit comprising only one capacitor, wherein one electrode of the one capacitor is directly coupled to the second end of the scan switch, and the other electrode of the one capacitor is directly coupled to the second ends of the plurality of storage switches, and the scan switch is turned on during a scan period and the storage switches are sequentially turned on during the scan period.

6. The display driving circuit as claimed in claim 5, wherein the assistant unit is arranged to provide a low voltage to the storage units.

7. A display driving circuit, comprising:

a plurality of storage units, wherein each storage unit comprises:

at least one storage capacitor storing a data signal;

at least one driving transistor controlled by the data signal; and at least one organic light emitting diode driven by the driving transistor;

an assistant unit shared by the storage units to compensate for a plurality of driving voltages or a plurality of driving currents of the storage units, wherein the assistant unit comprises only one capacitor;

a plurality of storage switches; and a scan switch coupled to a data line, wherein the storage switches are coupled with the scan switch through the one capacitor, and one electrode of the one capacitor is directly coupled to the scan switch, and the other electrode of the one capacitor is directly coupled to the plurality of storage switches.

8. The display driving circuit as claimed in claim 7, wherein a source of the driving transistor of each storage unit and one end of the storage capacitor couple to a power end, a gate of the driving transistor couples to another end of the storage capacitor, a drain of the driving transistor couples to a positive pole of the organic light emitting diode, and a negative pole of the organic light emitting diode couples to a ground end.

9. The display driving circuit as claimed in claim 7, wherein the scan switch is arranged to transmit the data signals from the data line to the assistant unit.

10. The display driving circuit as claimed in claim 7, wherein the assistant unit is arranged to provide a low voltage to the storage capacitors.

11. The display driving circuit as claimed in claim 7, wherein when the scan switch is turned on, the storage switches are arranged to respectively transmit the data signals from the assistant unit to the corresponding storage units.

12. A display driving method, comprising:

transmitting a data signal to an assistant unit through a scan switch, wherein the assistant unit is coupled to a plurality of storage units through a plurality of storage switches; and switching to transmit the data signal from the assistant unit to one of the storage units by the storage switches, wherein the assistant unit is shared by the storage units to compensate for a plurality of driving voltages or a plurality of driving currents of the storage units, the assistant unit comprises only one capacitor, and the storage switches are coupled with the scan switch through the at least one capacitor, and one electrode of the one capacitor is directly coupled to the scan switch, and the other electrode of the one capacitor is directly coupled to the plurality of storage switches.

13. The display driving method as claimed in claim 12, further comprising providing a low voltage to the storage units.

* * * * *